US006092719A

United States Patent [19]

Capo

[11] Patent Number: 6,092,719

[45] Date of Patent: Jul. 25, 2000

[54] CONTAINER FORMED OF IDENTICAL CONTAINER ELEMENTS AND BLANK FOR FORMING THE SAME

[75] Inventor: James L. Capo, Middletown, Ohio

[73] Assignee: Graphic Packaging Corporation, Golden, Colo.

[21] Appl. No.: 09/025,840

[22] Filed: Feb. 19, 1998

[51] Int. Cl.[7] ..... B65D 5/20; B65D 5/68

[52] U.S. Cl. ..... 229/125.28; 229/114; 229/901

[58] Field of Search ..... 229/114, 125.28, 229/125.27, 901, 902, 906

[56] References Cited

U.S. PATENT DOCUMENTS

| | | | |
|---|---|---|---|
| D. 241,821 | 10/1976 | Jewell . | |
| D. 344,023 | 2/1994 | Eisman . | |
| D. 348,609 | 7/1994 | Eisman et al. . | |
| 2,777,630 | 1/1957 | Moberger | 229/125.28 |
| 2,999,626 | 9/1961 | McDermott | 229/125.28 |
| 3,027,062 | 3/1962 | Huss et al. . | |
| 4,470,538 | 9/1984 | Heathcock et al. . | |
| 4,717,070 | 1/1988 | Taub | 229/125.28 |
| 4,804,137 | 2/1989 | Harby . | |
| 4,856,707 | 8/1989 | Lorenz . | |
| 4,930,681 | 6/1990 | Fultz et al. | 229/125.27 |
| 5,060,851 | 10/1991 | Lorenz . | |
| 5,160,081 | 11/1992 | Beales . | |
| 5,188,284 | 2/1993 | Eisman . | |
| 5,364,018 | 11/1994 | Carlsson . | |

FOREIGN PATENT DOCUMENTS

| | | | |
|---|---|---|---|
| 520131 | 12/1992 | European Pat. Off. | 229/125.28 |
| 2 659 062 | 3/1990 | France . | |
| 2659062 | 9/1991 | France | 229/125.28 |

*Primary Examiner*—Gary E. Elkins
*Attorney, Agent, or Firm*—Sixbey, Friedman, Leedom & Ferguson, PC; Charles M. Leedom, Jr.; Donald R. Studebaker

[57] ABSTRACT

A container body formed from two substantially identical interlocking container members with each of the container members comprising a substantially planer base portion and a plurality of opposing sidewalls connected to the base portion and tab portions extending from at least one pair of the opposing sidewalls with each of the tab portions including an opening and an adjacent interference element is set forth. The interference elements of a first of the two container members is received in respective openings of a second of the two container members for securing the second container member in an inverted condition with respect to the first container member.

A blank for forming the respective container members similarly includes a base portion and at least two pairs of opposing sidewalls hingedly connected to the base portion along lines of weakness and tab portions extending from each sidewall of one of the pairs of opposing sidewalls with each of the tab portions including an opening and adjacent interference element. When erected, the container blank forms one of a cover or tray which are nestably received within one another for packaging, shipping and storing of the container members. When in use, the container body is erected by interlocking a first container member and a second container member. The container members are capable of being interlock with another irrespective of their longitudinal orientation with respect to one another. The tab portions of each of the container members which include both an interference member and an adjacent opening for receiving an interference member are aligned with one another even if the container members are rotated 180° with respect to one another. Particularly, the tab portions on each of side walls are identical, thus the need to provide the correct longitudinal orientation is eliminated.

28 Claims, 4 Drawing Sheets

FIG. 5
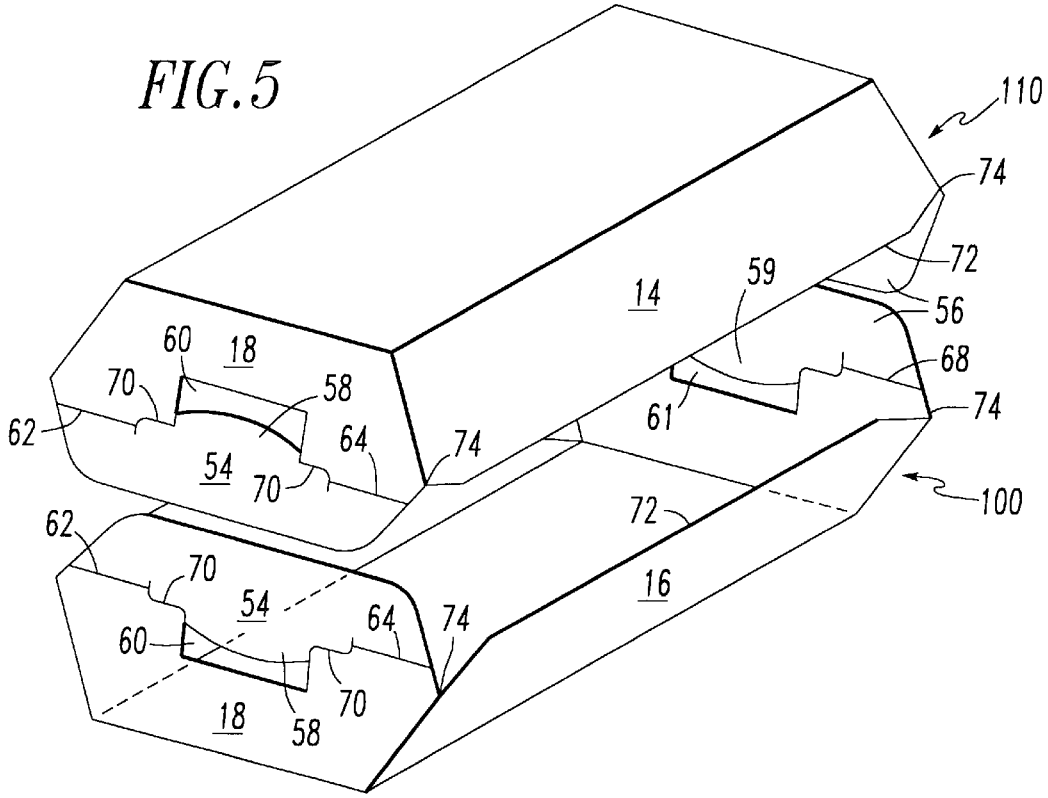
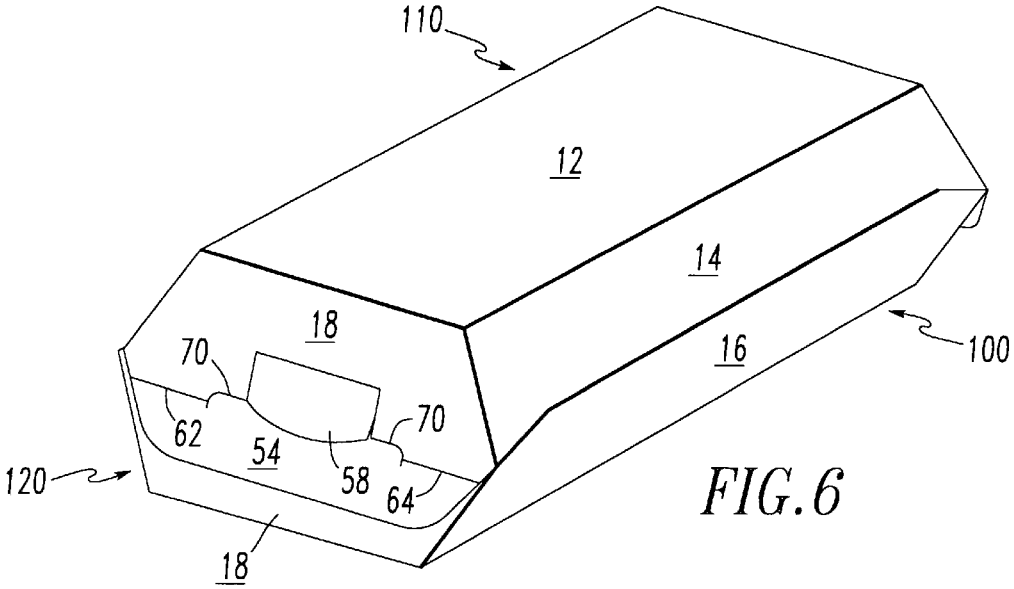
FIG. 6

CONTAINER FORMED OF IDENTICAL CONTAINER ELEMENTS AND BLANK FOR FORMING THE SAME

TECHNICAL FIELD OF INVENTION

The present invention is directed to a two-part container wherein each part making up the container is identical to the other. More particularly, the present invention is directed to a two-part container wherein two complementary container pieces of identical construction forming an interchangeable base and cover of the container.

BACKGROUND OF THE INVENTION

As noted hereinabove, the present invention is directed to a container comprising two complementary container pieces which form a container particularly suitable for use in the fast food industry. Containers of this type are well known in the art. In this industry, emphasis is placed on constructing the two-piece tray-type cartons or containers such that they may be easily joined together to enclose an item. An early version of this type of container is set forth in U.S. Pat. No. 3,027,062 issued to Huss et al.

Huss et al. discloses a combination tray and cover adapted to be interlocked with one another to contain an article. Therein, the tray and cover preferably are constructed from blanks of identical size and contour. The side walls of each tray and the cover piece include a locking tab located at the top edge thereof having a male portion delineated by a slit and a counter tab. To interlock the tray and cover, the cover is positioned over the tray so that the interlocking tabs of the two pieces are placed in contact. Thereafter, the tray and cover are rotated relative to one another until the male portions of the interlocking tabs of each piece lockingly engaged with the slits of the other piece. The cover can similarly be removed by twisting in the opposite rotational direction. However, it is noted that this container requires a particular manipulation of the cover with respect to the tray which may result in misalignment of the locking tabs of the two pieces. Additionally, when handled by the consumer, the cover may become inadvertently dislodged from the tray.

In an effort to overcome the aforementioned shortcomings, locking trays of the type illustrated in U.S. Pat. Nos. 4,856,707 issued to Lorenz, 5,160,081 issued to Beales, and 5,188,284 issued to Eisman have been proposed. Each of these locking trays include a cover and tray portion which are formed from substantially identical blanks. Both the cover and tray of each of these references include outwardly extending locking tabs which interfere with similar locking tabs of the other of the tray or cover in order to secure the cover in place with respect to the tray. With the locking tray set forth in U.S. Pat. No. 4,856,707, in order for the tray and cover to be formed of identical blanks, the resultant container must be of a square configuration. Furthermore, with each of the above-noted type locking trays, the extending tabs which extend beyond the confines of the tray or cover are readily susceptible to damage by either bending or tearing of the tabs. If such occurs, it will be difficult if not impossible to interlock the trays in the proposed manner.

In a still further effort to overcome the aforementioned shortcomings, a locking tray of the type set forth in U.S. Pat. No. 5,060,851 issued to Lorenz is utilized wherein a cover and tray are manufactured from similar blanks with a first pair of opposing sidewalls of each piece having an upstanding tab portion extending from the top edge of the central portion of the sidewall and a second pair of opposing sidewalls of each piece including two spaced-apart upstanding portions for receiving an associated tab portion therebetween to interlock the container pieces. While this construction obviates the aforementioned shortcomings associated with the prior containers, this reference continues to falter from the possibility that the interlocking members will not fully interlock with one another resulting in the dislodging of the cover with respect to the tray. Further, if the outer flanges of the cover which are exposed are grasped by the consumer in order to carry a container including hot contents, the cover will be readily dislodged from the tray resulting in the tray dropping with respect to the cover.

A still further effort to overcome aforementioned shortcomings is set forth in U.S. Pat. No. 4,804,137 issued to Hardy and includes a container having a bottom tray and a like tray which is inverted and rotated 90° with respect to the bottom tray to form a lid or cover for the bottom tray. Once positioned over the tray, the cover is adhered in place by extending flanges of both the cover and tray. While this ensures the placement of the cover over the tray, the cover may not be readily removed from the tray to gain access to the contents by the consumer. Additionally, if the container is anything but a square container, the cover and tray cannot be formed from identical blanks. In addition to the use of adhesives, the container of Hardy may include tabs formed in opposed extending flanges of the cover and tray with corresponding slots formed in the other opposing sidewalls of both the cover and tray for receiving the extended tabs of the other of the cover or tray. However, again such a construction requires that the container be of a square nature in order for the container to be formed from identical blanks. Moreover, when assembling the container in the manner set forth by Hardy, it requires that the locking tab and slot be aligned and secured for each of the four side walls of the container. Still further, due to the nature of the tab and slot arrangement of Hardy, the cover if grasped may be inadvertently dislodged from the tray.

The aforementioned shortcomings are further overcome by the containers set forth in each of U.S. Pat. Nos. 4,470,538 issued to Heathcock et al. and U.S. Pat. No. 5,364,018 issued to Carlsson as well as French Patent Publication No. 2659062. Each of these containers include a tray and cover formed of substantially identical blanks with one opposing pair of sidewalls including locking mechanisms for locking the containers together with respect to one another. In each of the disclosed containers, one opposed upstanding sidewall includes a locking tab or tongue while the other opposing sidewall includes an opening for receiving the locking tab. While the container of Carlsson and the French reference include locking tabs and openings which are extensions of the opposing sidewalls and the locking tab and opening of the Heathcock et al. container is formed integral with the sidewall, including an extension, the containers function substantially in an identical manner. Particularly, the container of the French reference and Heathcock et al. form what is commonly known as a clamshell type container requiring the cover and tray to be integrally connected to one another. While the aforementioned containers do form a positive locking tray and cover arrangement, the tray and cover themselves must be oriented and an opposing orientation in order to positively lock the cover in place over the tray. This requires the user to orient the cover in the appropriate manner with respect to the tray. That being, the locking tab of the cover must be oriented with respect to the opening of the tray and the locking tab of the tray must be oriented properly with respect to the opening of the cover. In a fast food type establishment, such a configuration may result in the improper securing of the cover with respect to the tray thus resulting in a cover which may be readily dislodged from the tray inadvertently uncovering the contents of the container or at a minimum requires additional manipulation of the tray and cover to ensure the proper orientation and thus the proper securing of the tray and cover with respect to one another.

Clearly, there is need for a locking container type of arrangement wherein the tray and cover are formed from identical blanks and further wherein the tray and cover may be oriented in either direction with respect to one another and still form a coherent lock between the cover and tray. Moreover, there is a need for a tray and cover arrangement which once secured may be reliably handled in the event that hot contents are placed in the container.

SUMMARY OF THE INVENTION

A primary object of the present invention is to overcome the aforementioned shortcomings associated with prior art container constructions.

A further object of the present invention is to provide a container which is particularly useful in fast food establishments which can be readily manipulated by the attendants and which results in a container wherein the interconnection between a cover and tray of the container is reliable.

A still further object of the present invention is to provide a container of the type useful in fast food establishments wherein prior to use trays and covers are readily nestable within one another for packaging, shipping and storage purposes.

Yet another object of the present invention is to provide an interlocking container wherein the locking mechanisms of both the container and tray are readily accessible to the user while being unobtrusive and less susceptible to damage.

A still further object of the present invention is to provide an interlocking container wherein both the tray and cover are of an identical construction.

A still further object of the present invention is to provide an interlocking container wherein both the cover and tray are symmetrical about a plane longitudinally bisecting the cover and tray as well as a plane transversely bisecting the cover and tray.

These as well as additional advantages of the present invention are achieved by a container body formed from two substantially identical interlocking container members with each of these container members comprising a substantially planer base portion and a plurality of opposing sidewalls connected to the base portion and tab portions extending from at least one pair of the opposing sidewalls with each of the tab portions including an opening and an adjacent interference element. The interference elements of a first of the two container members being received in respective openings of a second of the two container members for securing the second container member in an inverted condition with respect to the first container member.

A blank for forming the respective container members includes a base portion and at least two pairs of opposing sidewalls hingedly connected to the base portion along lines of weakness and tab portions extending from each sidewall of one of the pairs of opposing sidewalls with each of the tab portions including an opening and adjacent interference element. When erected, the container blank forms one of a cover or tray which are nestably received within one another for packaging, shipping and storing of the container members. When in use, the container body is erected from a first container member having a substantially planer base portion and a plurality of opposed sidewalls and a second container member having a substantially planar base portion and a plurality of opposed sidewalls with at least one pair of opposed sidewalls of both the first container member and the second container member including extended tab portions with the tab portions of each of the container members having an interference member and an adjacent opening for receiving an interference member of another of the container members. The container members are capable of being interlock with another irrespective of their longitudinal orientation with respect to one another. That is, the tab portions of each of the container members which include both an interference member and an adjacent opening for receiving an interference member are aligned with one another even if the container members are rotated 180° with respect to one another. Particularly, the tab portions on each of side walls are identical, thus the need to provide the correct longitudinal orientation is eliminated.

These as well as additional objects of the present invention will become apparent from the following detailed description of the present invention when read in light of the several figures.

BRIEF DESCRIPTION OF THE DRAWINGS

FIG. 5 is a perspective view of the cover of FIG. 3 positioned adjacent the tray of FIG. 2 prior to interlocking of the container members.

FIG. 6 is a perspective view of the interlocking container formed in accordance with the present invention.

DETAILED DESCRIPTION OF THE PRESENT INVENTION

Figure 1:
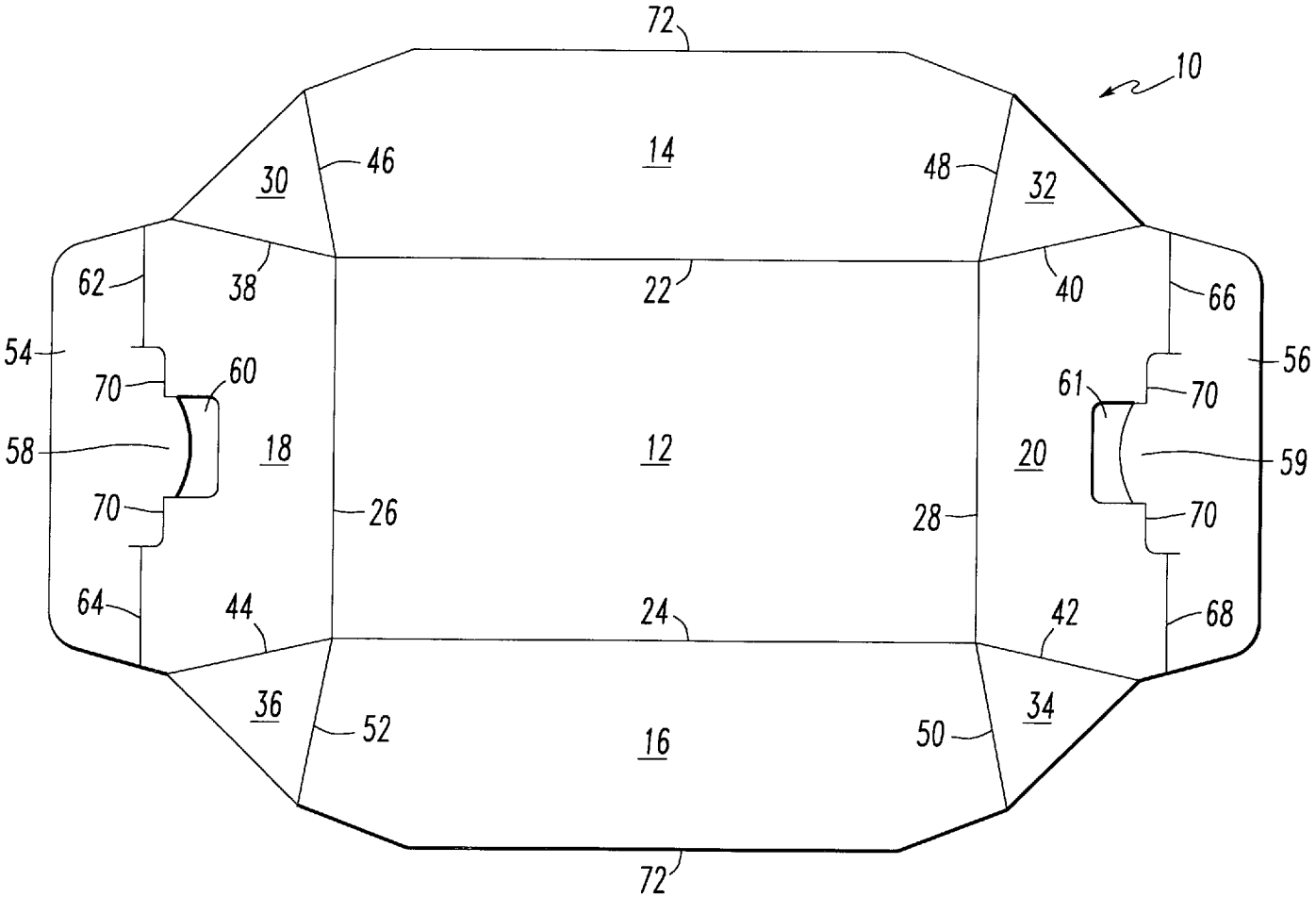
FIG. 1 is a plan view of a blank for forming a portion of an interlocking container formed in accordance with the present invention.

With reference to the several figures wherein like reference numerals will be utilized to designate like features throughout the several figures. FIG. 1 illustrates a blank for forming a container in accordance with the present invention.

The blank 10 includes a base portion 12 having hingedly connected thereto about a periphery of the base portion 12, a plurality of side walls 14, 16, 18 and 20. Each of these side walls be hingedly connected to the base portion 12 by lines of weakness or crease score fold lines 22, 24, 26 and 28, respectively. Formed between each adjacent side walls are sealing flaps 30, 32, 34 and 36 which are hingedly connected to one of the adjacent side walls along a crease score line while being separated from the other of the adjacent side walls by a cut score line. In accordance with the preferred embodiment, the sealing flaps 30, 32, 34 and 36 are preferably hingedly secured to the side walls 18 and 20 along crease score fold lines 38, 40, 42 and 44 with cut score lines 46, 48, 50 and 52 separating the sealing flaps from the side walls 14 and 16, respectively. In this regard, adhesive may be applied to an outer surface of each of the sealing flaps 30, 32, 34 and 36 with these flaps being adhered to an inside surface of side walls 14 and 16 when the side walls are folded along prescore fold lines 22, 24, 26 and 28, thus forming a container element in accordance with the present invention.

Each of the side walls 18 and 20 include an extended tab portions 54 and 56, respectively. The particular importance of the extended tab portions will be discussed in greater detail hereinbelow, however, each of the extended tab portions 54 and 56 include locking or interference elements 58 and 59, respectively, as well as adjacent openings 60 and 61, respectively. The openings 60 and 61 are in fact a void in the blank material wherein the blank material in this area has been removed. The separation between the side wall 18 and the tab portion 54 is defined by crease score fold lines 62 and 64 while the separation between side wall 20 and extending tab 56 is defined by crease score fold lines 66 and 68. Each of these crease score fold lines extend from an outer parameter of the extending tab to cut lines 70 and 71, respectively which define the interference elements 58 and 59, respectively. While the particular formation of the extended tab portions 54 and 56, the interference elements 58 and 59 and openings 60 and 61 are not critical to the present invention, the configuration set forth herein has been determined to provide a locking mechanism which permits the user to readily combine the container elements in a manner which will be discussed in greater detail hereinbelow.

As with many containers of this type, the blank is formed of a paperboard material. Further, the blank may be coated on a surface which will eventually form an interior of the container with a containment protection coating such as a thermoplastic coating. Preferably, both surfaces of the blank are coated with such material with a thickness of both the paperboard blank and thermoplastic material being dictated by the ultimate use of the container.

As with prior containers of this type, by providing the thermoplastic coating on at least an interior surface of the blank results in a number of benefits. For example, the paperboard material becomes substantially impermeable to a liquid which maintains the contents of the container within such container. An additional benefit of providing a thermoplastic coating on at least an interior surface of the blank is when the container is erected from the blank, the assembly is easily accomplished through the use of high speed forming and packaging machines. In this regard, the container members formed in accordance with the present invention may be readily constructed using such high speed machines. In that the sealing flaps are hingedly connected to each of side walls 18 and 20, when the blank is formed into a container element, the side walls 14 and 16 are folded to an upstanding position without any restraint being imposed thereon through a connection to the sealing flaps. Either after or simultaneously with the folding of the side walls 14 and 16 into their upstanding position, the side walls 18 and 20 may be folded and, thereafter the sealing flaps 30, 32, 34 and 36 may be positioned interiorly of the side walls 14 and 16. Although a number of methods may be utilized to adhere or bond the sealing flaps 30, 32, 34 and 36 to the respective side walls 14 and 16, a preferred construction results from coating at least an interior surface of the container blank 10 made of thermoplastic such as polyethylene such that the sealing flaps may be heat sealed to the side walls. Even more preferably, such adhesion would be more reliable if both the interior and exterior surface of the blank 10 were coated with the thermoplastic material. In any event, any means for adhering the sealing flaps to their respective side walls may be utilized.

Figure 2:
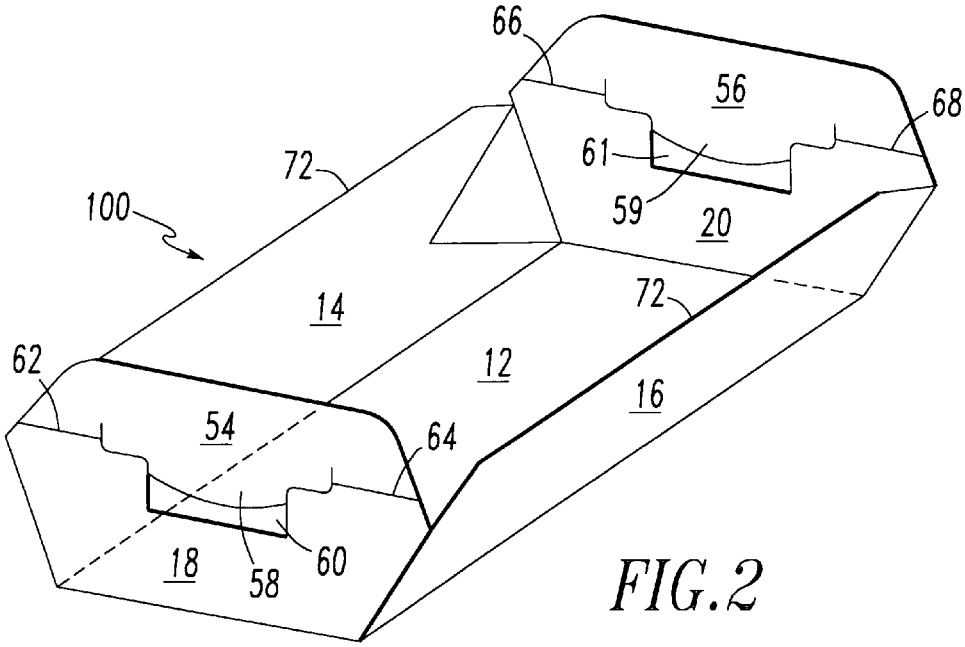
FIG. 2 is a perspective view of a tray for forming the interlocking container in accordance with the present invention.
Figure 3:
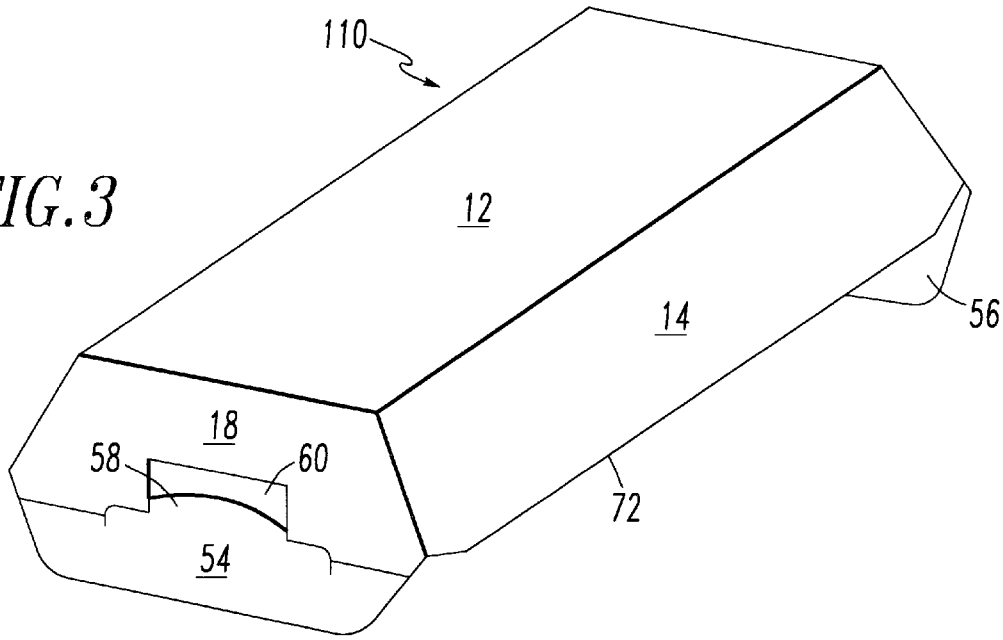
FIG. 3 is a perspective view of a cover for forming the interlocking container in accordance with the present invention.

FIGS. 2 and 3 illustrate container elements which are formed in accordance with the above-mentioned procedure. Each of these container elements are identical, however, one container element serves as a tray 100 while the other container element serves as a cover 110. Both the tray 100 and cover 110 include the base portion 12 as well as the plurality of side walls 14, 16, 18 and 20. It can be noted that each of these side walls 14 and 16 include an extension 72 which as will be discussed in greater detail hereinbelow aids in the forming of a resultant container. As noted hereinabove with respect to the blank, each of side walls 18 and 20 include extended tab portions 54 and 56, respectively. Each of the extended tab portions 54 and 56 include the locking or interference element 58–59, as well as the adjacent opening 60–61. As can be appreciated from the FIGS. 2 and 3, the opening 60–61 is a void in the paperboard material wherein the paperboard material in this area has been removed. The tab portion 54 is defined by the prescore fold lines 62 and 64 while the tab portion 56 is defined by crease score fold lines 66 an 68. These fold lines aid in the displacement of the interference elements 58 and 59, the significance of which will be discussed in greater detail hereinbelow. Again, while the particular formation of the extended tab portions 54 and 56, the interference elements 58 and 59 and the openings 60 and 61 are not critical to the present invention, the configuration set forth herein has been determined to provide a locking mechanism which permits the user to readily combine the container elements 100 and 110 in a reliable and efficient manner.

Figure 4:
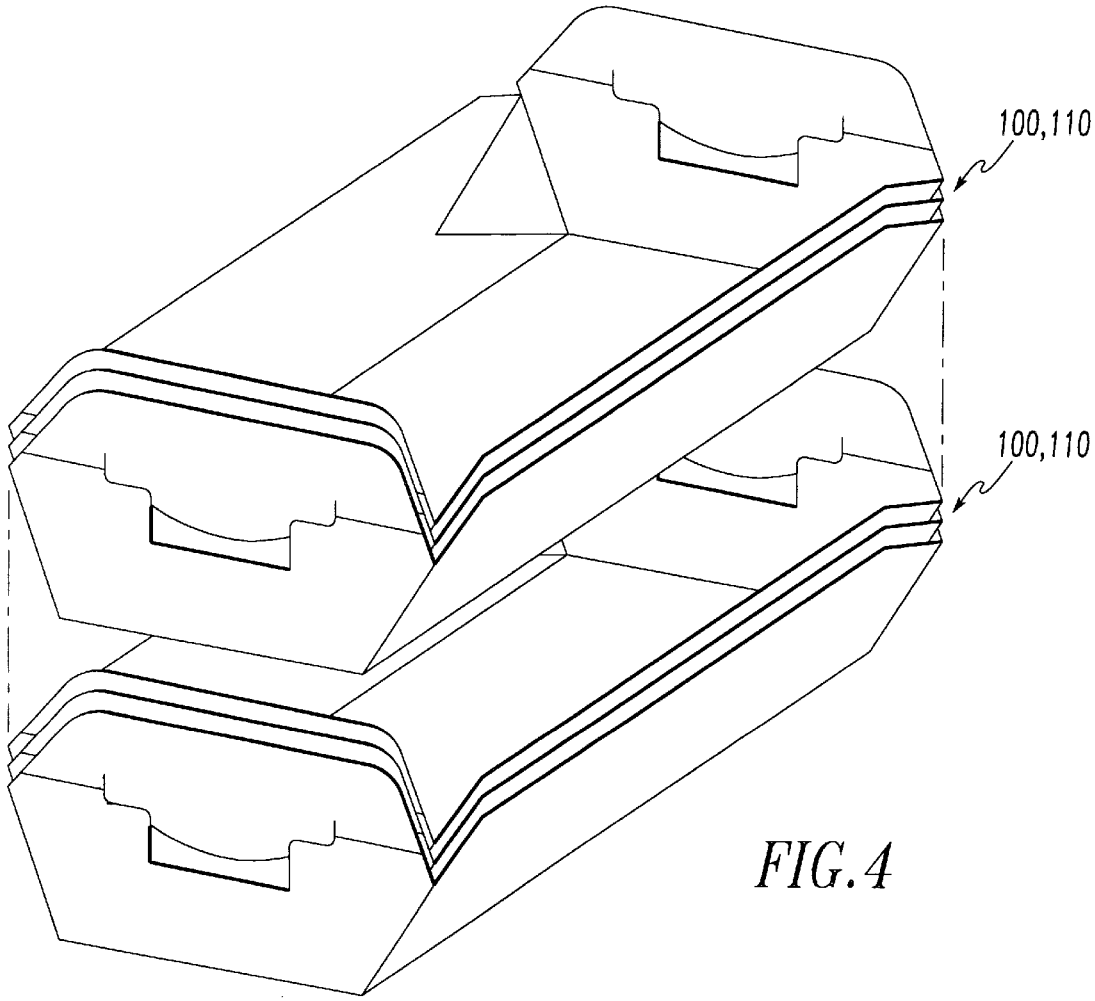
FIG. 4 is a perspective view of a plurality of trays and covers illustrated in FIGS. 2 and 3 stacked one upon the other and nesting within one another.

With reference to FIG. 4, because the tray 100 and cover 110 are formed from identical blanks and are thus of an identical configuration, these formed container elements may be readily stacked one upon the other and nested within one another. This provides for efficient packaging, shipping and storing of the container elements. The particular number of container elements which are stacked one upon the other and nested within one another is dictated primarily by packaging constraints. However, it is clear that the pressure exerted on the lowermost container element should not exceed a predetermined value which may damage the container element.

With reference now to FIGS. 5 and 6, the forming of a container from the tray 100 and cover 110 will now be explained in greater detail. Particularly, because the tray 100 and cover 110 are identical, any two components removed from the nested stack illustrated in FIG. 4 may be utilized in forming the resultant container 120. Additionally, because the end portions of each of tray 100 and cover 110 are identical, the longitudinal orientation of the tray 100 with respect to the cover 110 is irrelevant. Accordingly, the user need only grasp the top two container elements from the nested stack and align them in a longitudinal manner.

Once the contents of the container are placed within the tray 100, the cover 110 is placed over the tray 100 such that the extensions 72 of side walls 14 and 16 of the cover 110 are positioned inboard of the extensions 72 of the side walls 14 and 16 of the tray 100 and the extension tab 54 of the side wall 18 of the cover 110 is positioned outboard of the extension 54 of the side wall 18 of the tray 100. As is illustrated in FIG. 5, the extension 72 include tapered edges which form abutment troughs 74 at the meeting points between respective adjacent side walls. The troughs 74 of the cover 110 contact the troughs 74 of the tray 100 so as to support the cover 110 in a position above the tray 100.

Because the extension 72 of the cover 110 are inboard of the extension 72 of the tray 100 and the extended tab portions 54 and 56 of the cover 110 are outboard of the extended tab portions 54 and 56 of the tray 100, contact between the troughs 74 of the tray 100 and cover 110, respectively stops continued telescopic advancement of the cover 110 into the tray 100.

Once the cover 110 is received within the tray 100 such that troughs 74 abut one another, the extended tab portions 54 and 56 of the cover 110 are grasped and pivoted slightly outwardly along crease score fold lines 62, 64 and 66, 68, respectively so as to position the interference element 58 of the cover 110 inboard of the interference element 58 of the tray 100 such that the interference element 58 of the cover 110 extends into the opening 60 formed in the tray 100 and the interference element 58 of the tray 100 extends through the opening 60 formed in the cover 10 by pivoting the extended tab 54 about the crease score fold lines 62 and 64, the cut lines 70 permit the interference element 58 to likewise pivot with respect to the side wall 18. In doing so, the interference element 58 of the cover 110 is permitted to interlock with the interference element 58 of the tray 100. Again, it should be noted that the longitudinal orientation of the cover 110 with respect to the tray 100 is not of particular importance in that the end portions of the tray 110 and cover 100 are identical. Consequently, the interference elements 58 and 59 are identical and interlock with one another in the same manner as that discussed hereinabove. It is further noted that while it is preferred that the extension 72 of the cover 110 be inboard of the extension 72 of the tray 100, and the side walls 18 and 20 of the cover 110 be outboard of the side walls 18 and 20 of the tray 100, this orientation may be reversed without departing from spirit and scope of the invention. Again, the troughs 74 of both the cover 110 and tray 100 will stop telescopic movement of the cover 110 with respect to the tray 100.

Figure 7:
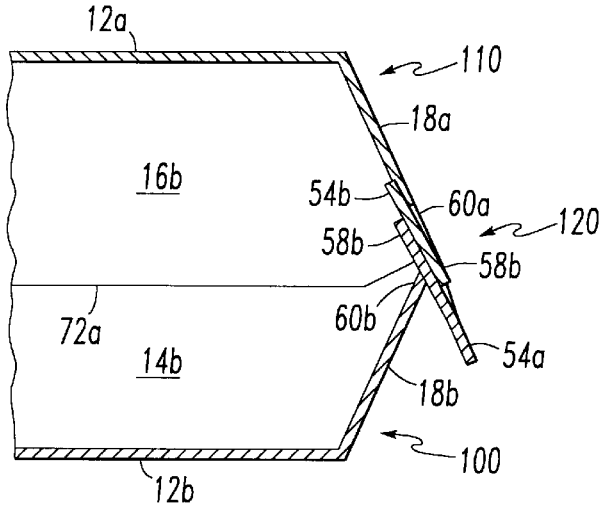
FIG. 7 is a cross-sectional view taken along a line longitudinally bisecting the container illustrated in FIG. 6.

Referring now to FIG. 7, the interlocking the tray 100 and cover 110 is illustrated in detail. In this regard, reference numerals which relate to the cover 110 will include a subscript a while reference numerals relating to the tray 100 will include a subscript b.

As noted hereinabove, FIG. 7 is a cross-sectional view of the container illustrated in FIG. 6, taken along a plane which longitudinally bisects the container 120. As discussed hereinabove, the cover 110 includes a base portion 12*a* and side walls 16*a* and 18*a*. Likewise, the tray 100 includes a base portion 12*b* and side walls 14*b* and 18*b*. As is also illustrated in FIG. 7, the extension 72*a* extends inboard of the side wall 14*b*.

As discussed hereinabove, interlocking of the cover 110 with respect to the tray 100 is carried out by pivoting the extending tab portion 54*a* along fold lines 62 and 64 so as to place the interference element 58*a* inboard of the interference element 58*b*. Additionally, the cut lines 70 (not illustrated in FIG. 7) aid in the interconnection between the interference elements 58*a* and 58*b*. In doing so, the extended tab portions 54*a* of the cover 110 may be used as a mechanism for handling the container 120 should the container contain a hot product. Additionally, the cover 110 may be readily removed from the tray 100 by again pivoting the tab portions 54 and 56 along fold lines 62, 64 and 66, 68, respectively, so as to draw the interference elements 58 and 59 of the cover 110 outward from the interference elements 58 and 59 of the tray 100. Additionally, it is possible to only open one end of the container 120 and pivot the cover 110 with respect to the tray 100 leaving the opposing end of the container 120 interlocked together. Crease score fold lines 62, 64 and 66, 68, respectively, aid in the pivoting of the cover with respect to the tray forming what is known as a clam shell type container.

Accordingly, as can be seen from the foregoing discussion, a locking container having a tray and cover formed from identical blanks and further wherein the tray and cover may be oriented in either direction with respect to one another and still form a coherent lock between the cover and tray is provided. Additionally, a container is provided which once the cover and tray are interlocked with one another provides a construction which may be readily handled in the event that hot contents are placed in the container. Additionally, the container elements which are utilized in forming the container in accordance with the present invention may be readily nestable within one another and stacked for ease in packaging, shipping and storing of the container elements. Further, because the container tray and cover are of an identical construction, the user need only take two container elements from a single stack and form a container regardless of the longitudinal orientation of the container elements. This is particularly achieved by providing container elements formed from identical single blanks, which when formed into container elements are of a symmetrical configuration. That is, the container elements are symmetrical about a plane longitudinally bisecting the container element as well as a plane laterally bisecting the container element.

While the present invention has been described with reference to a preferred embodiment, it will be appreciated by those skilled in the art that the invention may be practiced otherwise than as specifically described herein without departing from the spirit and scope of the invention. It is, therefore, to be understood that the spirit and scope of the invention be limited only by the appended claims.

I claim:

1. A container body comprising:

a first container member having a substantially planar base portion and at least one pair of opposed side walls extending therefrom;

a second container member having a substantially planar base portion and at least one pair of opposed side walls extending therefrom;

each wall of said at least one pair of opposed side walls of said first container member and each wall of said at least one pair of opposed side walls of said second container member including an extended tab portion, each said tab portion having an interference element and an inner opening adjacent said interference element for receiving said interference element of said tab portion of said at least one pair of said opposed side walls of one of said first and second container members; and wherein said inner opening is void of material.

2. The container body of claim 1, wherein said first and second container members are assembled in a first orientation and a second orientation, wherein said second orientation is 180° rotated from said first orientation.

3. The container body of claim 1, wherein each said extended tab portion is defined by an upper perimeter of a respective opposed side wall and a crease score fold line extending from a perimeter of said extended tab portion and substantially parallel to said respective substantially planar base portion.

4. The container body of claim 3, wherein said crease score fold line intersects a cut line defining a respective interference element.

5. The container body of claim 4, wherein each said cut score line includes a first section extending substantially perpendicular to said crease score fold line and a second section extending substantially parallel to said crease score line.

6. The container body of claim 5, wherein said crease score fold line intersects said first section of said cut line.

7. The container body of claim 6, wherein said second section of said cut line intersects said opening.

8. The container body of claim 3, wherein each said interference element and each said adjacent opening are centrally positioned on a respective extended tab portion.

9. The container body of claim 8, wherein said first and second container members are symmetrical about a plane longitudinally bisecting the container body.

10. The container body of claim 8, wherein said first and second container members are symmetrical about a plane laterally bisecting the container body.

11. A container body formed from two substantially identical interlocking container members, each of said container members comprising:

a substantially planar base portion and at least one pair of opposing side walls extending from said base portion; and a tab portion extending from each wall of said at least one pair of opposing side walls, each said tab portion including an inner opening and an adjacent interference element, each said interference element of a first of the two container members being received in a respective opening of a second of the two container members for securing the second container member in an inverted condition with respect to the first container member, each said inner opening being void of material.

12. The container body of claim 11, wherein each said interference element and each said adjacent opening are centrally positioned on a respective extended tab portion.

13. The container body of claim 12, wherein said first and second container members are symmetrical about a plane longitudinally bisecting the container body.

14. The container body of claim 13, wherein said first and second container members are symmetrical about a plane laterally bisecting the container body.

15. The container body of claim 14, wherein each said extended tab portion is defined by an upper perimeter of a respective opposed side wall and a crease score fold line extending from a perimeter of said extended tab portion and substantially parallel to said substantially planar base portion.

16. The container body of claim 15, wherein said crease score fold line intersects a cut line defining said interference element.

17. The container body of claim 16, wherein said cut line includes a first section extending substantially perpendicular to said crease score fold line and a second section extending substantially parallel to said crease score line.

18. The container body of claim 17, wherein said crease score fold line intersects said first section of said cut line.

19. The container body of claim 18, wherein said second section of said cut line intersects said respective opening.

20. A blank for forming a portion of a container body, said blank comprising:

a base portion;

at least two pairs of opposing side walls hingedly connected to said base portion along lines of weakness; and a tab portion extending from each side wall of one of said pairs of opposing side walls; each said tab portion including an inner opening and an adjacent interference element, each said inner opening being void of material.

21. The blank of claim 20, wherein each said interference element and each said adjacent opening are centrally positioned on a respective extended tab portion.

22. The blank of claim 20, wherein the blank is symmetrical about a plane longitudinally bisecting the blank.

23. The blank of claim 22, wherein the blank is symmetrical about a plane laterally bisecting the blank.

24. The blank of claim 20, wherein each said extended tab portion is defined by an upper perimeter of a respective opposed side wall and a crease score fold line extending from a perimeter of said extended tab portion and substantially parallel to said substantially planar base portion.

25. The blank of claim 24, wherein said crease score fold line intersects a cut line defining said interference element.

26. The blank of claim 25, wherein said crease score fold line intersects said first section of said cut line.

27. The blank of claim 24, wherein said cut line includes a first section extending substantially perpendicular to said crease score fold line and a second section extending substantially parallel to said crease score line.

28. The blank of claim 27, wherein said second section of said cut line intersects said respective opening.

* * * * *